US006187739B1

(12) United States Patent
Merz et al.

(10) Patent No.: US 6,187,739 B1
(45) **Date of Patent: *Feb. 13, 2001**

(54) PASTE-FORM WASHING AND CLEANING AGENTS

(75) Inventors: Thomas Merz, Hilden; Khalil Shamayeli, Duesseldorf; Guenther Amberg, Neuss; Heinz-Manfred Wilsberg, Duesseldorf, all of (DE)

(73) Assignee: Henkel Kommanditgesellschaft auf Aktien, Duesseldorf (DE)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/043,970

(22) PCT Filed: Sep. 13, 1996

(86) PCT No.: PCT/EP96/04024

§ 371 Date: Mar. 20, 1998

§ 102(e) Date: Mar. 20, 1998

(87) PCT Pub. No.: WO97/11150

PCT Pub. Date: Mar. 27, 1997

(30) Foreign Application Priority Data

Sep. 21, 1995 (DE) ..... 195 35 082

(51) Int. Cl.[7] ..... C11D 17/00; C11D 3/39; C11D 1/72; C11D 1/83

(52) U.S. Cl. ..... 510/371; 510/376; 510/304; 510/311; 510/404; 510/315; 510/377; 510/316; 510/318

(58) Field of Search ..... 510/371, 376, 510/304, 311, 404, 315, 377, 316, 318

(56) References Cited

U.S. PATENT DOCUMENTS

| | | | |
|---|---|---|---|
| 4,144,226 | 3/1979 | Crutchfield et al. | 528/231 |
| 4,146,495 | 3/1979 | Crutchfield et al. | 252/89 R |
| 4,305,749 | 12/1981 | Mildenberger et al. | 71/67 |

(List continued on next page.)

FOREIGN PATENT DOCUMENTS

| | | |
|---|---|---|
| 9458592 | 8/1994 | (AU) . |
| 814956 | 6/1969 | (CA) . |
| 958618 | 12/1974 | (CA) . |
| 989557 | 5/1976 | (CA) . |
| 1036455 | 8/1978 | (CA) . |
| 2 172 602 | 4/1995 | (CA) . |
| 2146063 | 10/1995 | (CA) . |
| 16 17 141 | 4/1972 | (DE) . |
| 22 53 063 | 5/1973 | (DE) . |
| 22 00 911 | 10/1973 | (DE) . |
| 24 12 837 | 10/1974 | (DE) . |
| 42 21 381 | 2/1994 | (DE) . |
| 43 00 772 | 7/1994 | (DE) . |
| 44 30 418 | 10/1995 | (DE) . |
| 195 29 905 | 2/1997 | (DE) . |
| 195 36 082 | 4/1997 | (DE) . |
| 195 05 906 | 8/1997 | (DE) . |
| 196 05 688 | 8/1997 | (DE) . |
| 196 20 411 | 10/1997 | (DE) . |
| 196 20 267 | 11/1997 | (DE) . |
| 0 022 551 | 1/1981 | (EP) . |
| 0 066 944 | 12/1982 | (EP) . |
| 0 164 514 | 12/1985 | (EP) . |
| 0 185 427 | 6/1986 | (EP) . |
| 0 234 867 | 9/1987 | (EP) . |
| 0 241 984 | 10/1987 | (EP) . |
| 0 253 151 | 1/1988 | (EP) . |
| 0 295 525 | 12/1988 | (EP) . |
| 0 356 707 | 3/1990 | (EP) . |
| 0 392 592 | 10/1990 | (EP) . |
| 0 443 651 | 8/1991 | (EP) . |
| 0 448 581 | 10/1991 | (EP) . |
| 0 458 397 | 11/1991 | (EP) . |
| 0 534 298 | 3/1993 | (EP) . |
| 0 544 490 | 6/1993 | (EP) . |
| 0 549 271 | 6/1993 | (EP) . |
| 0 630 964 | 12/1994 | (EP) . |
| 0 693 550 | 1/1996 | (EP) . |
| WO 90/06986 | 6/1990 | (WO) . |
| WO91/02792 | 3/1991 | (WO) . |
| WO91/08171 | 6/1991 | (WO) . |
| WO93/07276 | 4/1993 | (WO) . |
| WO93/08251 | 4/1993 | (WO) . |
| WO93/18140 | 9/1993 | (WO) . |
| WO 93/23521 | 11/1993 | (WO) . |
| WO93/24623 | 12/1993 | (WO) . |
| WO94/02618 | 2/1994 | (WO) . |
| WO94/23053 | 10/1994 | (WO) . |
| WO94/25579 | 11/1994 | (WO) . |
| WO94/25583 | 11/1994 | (WO) . |
| WO95/02044 | 1/1995 | (WO) . |
| WO95/05477 | 2/1995 | (WO) . |
| WO95/07350 | 3/1995 | (WO) . |
| WO95/09229 | 4/1995 | (WO) . |
| WO95/09263 | 4/1995 | (WO) . |
| WO95/10592 | 4/1995 | (WO) . |
| WO95/10615 | 4/1995 | (WO) . |
| WO95/20039 | 7/1995 | (WO) . |
| WO95/20663 | 8/1995 | (WO) . |
| WO95/23211 | 8/1995 | (WO) . |
| WO95/27049 | 10/1995 | (WO) . |
| WO95/29282 | 11/1995 | (WO) . |
| WO95/30010 | 11/1995 | (WO) . |
| WO95/30011 | 11/1995 | (WO) . |
| WO95/30743 | 11/1995 | (WO) . |
| WO95/34627 | 12/1995 | (WO) . |

*Primary Examiner*—Yogendra Gupta
*Assistant Examiner*—Brian P. Mruk
(74) *Attorney, Agent, or Firm*—Wayne C. Jaeschke; Glenn E. J. Murphy

(57) ABSTRACT

A paste-form detergent composition containing (A) 20% to 58% by weight of a liquid surfactant component consisting primarily of a nonionic surfactant, (B) 2% to 40% by weight of solid builders, and (C) 2% to 40% by weight of a solid bleaching component consisting of a peroxygen-containing oxidizing agent and a bleach activator, based on the weight of the composition.

15 Claims, No Drawings

U.S. PATENT DOCUMENTS

| | | | | |
|---|---|---|---|---|
| 4,372,868 | * | 2/1983 | Saran et al. | 252/102 |
| 4,664,839 | | 5/1987 | Rieck | 252/175 |
| 4,728,455 | * | 3/1988 | Rerek | 510/303 |
| 4,772,412 | * | 9/1988 | Green et al. | 510/371 |
| 4,820,439 | | 4/1989 | Rieck | 252/135 |
| 4,889,644 | | 12/1989 | Amberg et al. | 252/8.9 |
| 4,929,380 | | 5/1990 | Schulz et al. | 252/121 |
| 5,002,682 | * | 3/1991 | Bragg et al. | 510/311 |
| 5,114,611 | * | 5/1992 | Van Kralingen et al. | 252/186.33 |
| 5,221,488 | | 6/1993 | Amberg et al. | 252/8.9 |
| 5,266,233 | * | 11/1993 | Houghton et al. | 8/137 |
| 5,314,636 | * | 5/1994 | Rek et al. | 510/371 |
| 5,356,607 | | 10/1994 | Just | 423/334 |
| 5,417,951 | | 5/1995 | Just | 423/334 |
| 5,433,884 | * | 7/1995 | Altieri et al. | 510/407 |
| 5,441,661 | * | 8/1995 | Beaujean et al. | 252/95 |
| 5,456,850 | | 10/1995 | Trabitzsch et al. | 252/97 |
| 5,501,814 | | 3/1996 | Engelskirchen et al. | 252/174.17 |
| 5,518,645 | | 5/1996 | Beaujean et al. | 252/108 |
| 5,580,941 | | 12/1996 | Kraus et al. | 527/300 |
| 5,693,182 | | 12/1997 | Mathuni | 156/645.1 |
| 5,763,383 | * | 6/1998 | Hashida et al. | 510/392 |

* cited by examiner

PASTE-FORM WASHING AND CLEANING AGENTS

BACKGROUND OF THE INVENTION

1. Field of the Invention

This invention relates to bleach-containing paste-form detergents and to a process for their production.

2. Discussion of Related Art

Detergents used in the home are tailored to meet domestic requirements. Thus, they are normally powders or are sufficiently liquid to be able to be poured out and dispensed without difficulty. Since even liquid detergents are intended to be stable in storage over relatively broad temperature ranges, additions of organic solvents and/or hydrotropes are often incorporated although they do not make any contribution towards the washing or cleaning result and, for this reason, are undesirable. One way of overcoming possible dispensing problems with detergents having inadequate flow properties is proposed in European patent application EP 253 151 A2. This document describes liquid and, in some cases, highly viscous detergents based on nonionic and anionic surfactants which contain polyethylene glycol as the hydrotrope and which do not have to be dispensed in liquid form by the user, but instead are portion-packed in bags of a water-soluble material, for example polyvinyl alcohol.

The paste-form detergent described in European patent EP 295 525 B1 consists of a phase which is liquid at temperatures below 10° C. and which is formed by nonionic surfactant and of a solid phase dispersed therein which has a certain particle size and which is formed by washing alkalis, sequestering agents and optionally anionic surfactants. The surfactants or surfactant mixtures used are required to have pour points (solidification points) below 5° C. to avoid solidification of the paste at low transportation and storage temperatures. This detergent paste is intended for institutional laundries and is so-free flowing that it can be transported through a suction line by a standard feed pump. However, it has been found that pastes of the type in question are not always able satisfactorily to guarantee the homogeneity of their ingredients during the production process and, in many cases, even tend to separate in storage. This separation involves not only separation of the solid components from the liquid components, but also phase separation of the liquid ingredients.

Another paste-form detergent containing as nonionic surfactant 40 to 70% by weight of ethoxylated $C_{10-20}$ fatty alcohol liquid at room temperature with an average degree of ethoxylation of 1 to 8 and 20 to 50% by weight of ethoxylated and propoxylated $C_{10-20}$ fatty alcohol liquid at room temperature with an average degree of ethoxylation of 2 to 8 and an average degree of propoxylation of 1 to 6 and 1 to 10% by weight of soap is described in International patent application WO 95109229. This paste-form detergent is so pseudoplastic that it does not flow under the effect of gravity at room temperature, but assumes a much lower viscosity when subjected to shearing and is then able to flow under the effect of gravity. This paste-form detergent is preferably dispensed by applying shear forces to reduce its viscosity so that it is able to flow and can be dispensed by feed pumps.

European patent EP 0 448 581 B1 describes a liquid to paste-form bleach-containing detergent which—based on the detergent as a whole—contains (A) 20 to 35% by weight of a surfactant component consisting of (A1) 1 to 4% by weight of anionic surfactants from the class of sulfonates and soaps present as alkali metal salts and (A2) 16 to 34% by weight of nonionic surfactants having a pour point of at most 10° C., which are alkoxylated linear alcohols or 2-methyl-branched alcohols containing 10 to 18 carbon atoms or mixtures thereof, (B) 10 to 35% by weight of complexing or alkaline earth metal ion-binding builder salts, (C) 15 to 40% by weight of sodium metasilicate, (D) 8 to 25% by weight of bleaching persalts, (E) up to 15% by weight of other detergent ingredients and (F) less than 3% by weight of water, with the proviso that the sum total of components (B+C)=30 to 60% by weight.

The detergents described in the document cited above are highly viscous and have thixotropic properties. Even though the stability of the oxidizing agents incorporated in these detergents is described as adequate, it has been found that their cleaning effect, particularly on bleachable soils, is not satisfactory. It is precisely detergents used as perborate-containing detergents that are required to develop a particularly good bleaching effect so that even bleachable soil such as, for example, food residues and food dyes can be completely removed.

The problem addressed by the present invention was to provide a paste-form detergent which would show high stability in storage and which would contain both oxidizing agents and oxidation-boosting bleach activators so that it would have an excellent bleaching effect on bleachable soil.

DESCRIPTION OF THE INVENTION

The present invention relates to a paste-form detergent containing 20% by weight to 58% by weight of a surfactant component (A), which consists at least partly of nonionic surfactant, 2% by weight to 40% by weight of builders (B) and 2% by weight to 40% by weight of a bleaching component (C), characterized in that component (C) contains peroxygen-containing oxidizing agent and bleach activator.

The surfactants of component (A) or the nonionic element thereof are preferably selected from ethoxylated and optionally propoxylated alcohols corresponding to general formula I:

$$R^1—(OC_2H_4)_m—(OC_3H_6)_n—OH \quad (I)$$

in which $R^1$ is an alkyl or alkenyl group containing 6 to 11 carbon atoms, m may assume a value of 3 to 15 and n may assume a value of 0 to 6, and/or to general formula II:

$$R^2—(OC_2H_4)_o—(OC_3H_6)_p—OH \quad (II)$$

in which $R^2$ is an alkyl or alkenyl group containing 12 to 22 carbon atoms, o may assume a value of 3 to 15 and p may assume a value of 0 to 6.

The liquid phase of the detergent according to the invention is formed by component (A) which, according to the invention, contains nonionic surfactants, preferably ethoxylated and optionally propoxylated alcohols corresponding to general formula I and/or II which may have different carbon chain lengths. The viscosity of the detergent according to the invention may be adjusted by combining ethoxylated/propoxylated alcohols (I) and (II). In the compounds of formulae I and II, the substituents $R^1$ and $R^2$ may be linear or branched, for example methyl-branched in the 2-position (oxoalcohols). The nonionic surfactant corresponding to formula (I) preferably has a carbon chain length of 6 to 11 carbon atoms and an average degree of alkoxylation m of 3 to 15. The nonionic surfactant corresponding to formula (II) preferably has a carbon chain length of 12 to 22 carbon atoms, more particularly 12 to 15 carbon atoms, and an average degree of alkoxylation o of 3 to 15 and, more particularly, 5 to 15. The short-chain ethoxylated/propoxylated alcohols corresponding to formula (I) and the long-chain ethoxylated/propoxylated alcohols corresponding to formula (II) are preferably present in ratios by weight of 2:1 to 1:2. In one preferred embodiment, component (A) contains 20 to 40% by weight, based on component (A), of surfactants corresponding to formula I and/or II and from 60 to 80% by weight, based on component (A), of other anionic or nonionic surfactants typically used in detergents.

Component (A) may contain as further surfactants up to 10% by weight and preferably from 0.5% by weight to 8% by weight, based on component (A), of synthetic anionic surfactants. Suitable synthetic anionic surfactants, which may advantageously be incorporated in the detergent according to the invention in solid, fine-particle substantially water-free form, include in particular those of the sulfonate or sulfate type which are normally present as alkali metal salts, preferably sodium salts. However, the above-mentioned sulfonate-type surfactants in particular may also be used in the form of their free acids. Suitable anionic surfactants of the sulfonate type are alkyl benzene sulfonates containing linear $C_{9-13}$ alkyl chains, more particularly dodecyl benzene sulfonate, linear alkane sulfonates containing 11 to 15 carbon atoms, which may be obtained by sulfochlorination or sulfoxidation of alkanes and subsequent saponification or neutralization, salts of sulfofatty acids and esters thereof, which are derived from saturated $C_{12}$–$C_{18}$ fatty acids sulfonated in particular in the α-position and lower alcohols, such as methanol, ethanol and propanol, and olefin sulfonates which are formed, for example, by sulfonation of terminal $C_{12-18}$ olefins and subsequent alkaline hydrolysis. However, suitable surfactants of the sulfate type are in particular the primary alkyl and/or alkenyl sulfates with preferably linear $C_{10-20}$ alkyl chains which contain an alkali metal, ammonium or alkyl- or hydroxyalkyl-substituted ammonium ion as counter-cation. Particularly suitable are the derivatives of the linear alcohols containing in particular in 12 to 18 carbon atoms and branched-chain analogs thereof, the so-called oxoalcohols. Accordingly, the sulfation products of primary fatty alcohols with linear dodecyl, tetradecyl or octadecyl groups and mixtures thereof are particularly useful. Particularly preferred alkyl sulfates contain a tallow alkyl group, i.e. mixtures essentially containing hexadecyl and octadecyl groups. The alkyl sulfates may be obtained in known manner by reaction of the corresponding alcohol component with a typical sulfating agent, more particularly sulfur trioxide or chlorosulfonic acid, and subsequent neutralization with alkali metal, ammonium or alkyl- or hydroxyalkyl-substituted ammonium bases. In addition, the sulfated alkoxylation products of the alcohols mentioned, so-called ether sulfates, may be present in the detergents. These ether sulfates preferably contain 2 to 30 and, more particularly, 4 to 10 ethylene glycol groups per molecule.

In addition, the detergent according to the invention may contain up to 20% by weight and preferably from 0.5 to 8% by weight, based on the detergent as a whole, of soaps as part of component (A). Suitable soaps are, in particular, the alkali metal salts of saturated and/or unsaturated $C_{12-18}$ fatty acids, for example coconut oil, palm kernel oil or tallow fatty acid. A particularly preferred embodiment is characterized by the use of salts of a carboxylic acid mixture of—based on the carboxylic acid mixture as a whole—2% by weight to 8% by weight of $C_{14}$, up to 1% by weight of $C_{15}$ 18% by weight to 24% by weight of $C_{16}$, up to 3% by weight of $C_{17}$, 20% by weight to 42% by weight of $C_{18}$ and 30% by weight to 44% by weight of $C_{20-22}$ carboxylic acid.

Suitable low-temperature stabilizers are branched alcohols containing 6 to 15 carbon atoms and preferably 10 to 13 carbon atoms. The paste-form detergents according to the invention are substantially free from water and organic solvents. "Substantially free from water" means that the content of free water, i.e. water which is not present in the form of water of hydration and water of constitution, is preferably below 3% by weight, more preferably below 2% by weight and most preferably below 1% by weight. Higher water contents are a disadvantage because they disproportionately increase the viscosity of the detergent and, in particular, reduce its stability. Organic solvents, including the low molecular weight low-boiling alcohols and ether alcohols typically used in liquid concentrates, and hydrotropic compounds are also preferably absent apart from traces which may be introduced with individual active ingredients.

The solid phase of the preferred detergent is essentially formed by components (B) and (C), i.e. by the builders and the bleaching component, washing alkalis and, if desired, other auxiliaries optionally being present. The solid phase should be homogeneously dispersed in the liquid surfactant phase. Those constituents of the paste-form detergent which are present as the solid phase are intended to be particulate with a mean particle size of 5 μm to 200 μm, at most 10% of the particles having a particle size of more than 200 μm. Surprisingly, it is possible to incorporate relatively coarse-particle solids, for example solids containing 20 to 50% of particles larger than 100 μm in size, in the paste-form detergents without any disadvantages arising. The mean particle size of the particles forming the solid phase is preferably from 10 μm to 80μm and more preferably from 10 μm to 60 μm, the maximum particle size being below 300 μm and, more particularly, below 250 μm. In a preferred embodiment, 90% by weight of the solid powder-form components are smaller than 200 μm and, in particular, smaller than 140 μm. The mean particle size may be determined by known methods (for example by the laser diffraction method or by the Coulter Counter method).

Besides monomeric polycarboxylic acids, such as citric acid, and salts thereof, suitable builders are those from the class of aminopolycarboxylic acids and polyphosphonic acids. The aminopolycarboxylic acids include nitrilotriacetic acid, ethylenediamine tetraacetic acid, diethylenetriamine pentaacetic acid and higher homologs thereof, N,N-bis-(carboxymethyl)-aspartic acid preferably being used. Suitable polyphosphonic acids are 1-hydroxyethane-1,1-diphosphonic acid, aminotri(methylenephosphonic acid), ethylenediamine tetra(methylenephosphonic acid) and higher homologs thereof, such as for example diethylene tetramine tetra(methylenephosphonic acid). The acids mentioned are normally used in the form of their alkali metal salts, more particularly their sodium and potassium salts. Sodium nitrilotriacetate is preferably used in quantities of up to 10% by weight and, more particularly, in quantities of 2% by weight to 6% by weight. Other suitable builders are monomeric polycarboxylic acids and hydroxypolycarboxylic acids, more particularly in the form of their alkali metal salts, for example sodium citrate and/or sodium gluconate. The builders preferably used include homopolymeric and/or copolymeric carboxylic acids or alkali metal salts thereof, sodium and potassium salts being particularly preferred. Polymeric carboxylates and polymeric carboxylic acids with a relative molecular weight of at least 350 in the form of their water-soluble salts, more particularly in the form of their sodium and/or potassium salts, have proved to be particularly suitable; these include the oxidized polysaccharides according to International patent application WO 93/08251, polyacrylates, polymethacrylates, polymaleates and, in particular, copolymers of acrylic acid with maleic acid or maleic anhydride, preferably those of 50 to 70% acrylic acid and 50 to 10% maleic acid which are characterized, for example, in European patent EP 022 551. The relative molecular weight of the homopolymers is generally between 1,000 and 100,000 while the relative molecular weight of the copolymers is between 2,000 and 200,000 and preferably between 50,000 and 120,000, based on free acid. A particularly preferred acrylic acid/maleic acid copolymer has a relative molecular weight of 50,000 to 100,000. Suitable, but less preferred, compounds of this class are copolymers of acrylic acid or methacrylic acid with vinyl ethers, such as vinyl methyl ethers, vinyl esters, ethylene, propylene and styrene, in which the acid makes up at least 50% by weight. Other suitable polymeric carboxylates or carboxylic acids are terpolymers which contain two unsaturated acids and/or salts thereof as monomers and vinyl alcohol and/or a vinyl alcohol derivative or a carbohydrate as the third monomer. The first acidic monomer or its salt is derived from a monoethylenically unsaturated $C_{3-8}$ carboxylic acid and preferably from a $C_{3-4}$ monocarboxylic acid, more particularly from (meth)acrylic acid. The second acidic monomer or its salt may be a derivative of a $C_{4-8}$ dicarboxylic acid, maleic acid being preferred. In this case, the third monomeric unit is formed by vinyl alcohol and/or preferably an esterified vinyl alcohol. Vinyl alcohol derivatives which represent an ester of short-chain carboxylic acids, for example $C_{1-4}$ carboxylic acids, with vinyl alcohol are particularly preferred. Preferred terpolymers contain 60 to 95% by weight and, more particularly, 70 to 90% by weight of (meth)acrylic acid or (meth)acrylate, more preferably acrylic acid or acrylate, and maleic acid or maleate and 5 to 40% by weight and preferably 10 to 30% by weight of vinyl alcohol and/or vinyl acetate. Most particularly preferred terpolymers are those in which the ratio by weight of (meth)acrylic acid to maleic acid or maleate is between 1:1 and 4:1, preferably between 2:1 and 3:1 and more preferably between 2:1 and 2.5:1. Both the quantities and the ratios by weight mentioned are based on the acids. The second acidic monomer or its salt may even be a derivative of an allyl sulfonic acid substituted in the 2-position by an alkyl group, preferably by a $C_{1-4}$ alkyl group, or by an aromatic radical preferably derived from benzene or benzene derivatives. Preferred terpolymers contain 40 to 60% by weight and, more particularly, 45 to 55% by weight of (meth)acrylic acid or (meth)acrylate, more preferably acrylic acid or acrylate, 10 to 30% by weight and preferably 15 to 25% by weight of methallyl sulfonic acid or methallyl sulfonate and, as the third monomer, 15 to 40% by weight and preferably 20 to 40% by weight of a carbohydrate. This carbohydrate may be, for example, a monosaccharide, disaccharide, oligosaccharide or polysaccharide, mono-, di- or oligosaccharides being preferred. Sucrose is particularly preferred. Predetermined weak spots are incorporated in the polymer through the use of the third monomer and are probably responsible for the ready biodegradability of such polymers. The terpolymers used may be produced by any of the known methods normally used. Other preferred terpolymers are those which are either completely or at least partly neutralized, above all more than 50% (based on the carboxyl groups present) neutralized. Particularly preferred terpolymers are produced by the processes described in German patent application DE 43 00 772 and German patent DE 42 21 381. The polyacetal carboxylic acids described, for example, in U.S. Pat. Nos. 4,144,226 and 4,146,495, which are obtained by polymerization of esters of glycolic acid, introduction of stable terminal groups and saponification to the sodium or potassium salts are also suitable, as are the polymeric acids obtained by polymerization of acrolein and Canizzaro disproportionation of the polymer using strong alkalis. They are essentially made up of acrylic acid units and vinyl alcohol units or acrolein units.

If substances of the type in question are present at all in the paste-form detergents according to the invention, the percentage content of organic carboxyl-containing builders in the paste-form detergent according to the invention may be up to 10% by weight and is preferably from 1% by weight to 7.5% by weight and more preferably from 2% by weight to less than 5% by weight while the percentage content of polyphosphonic acids may be up to 3% by weight and is preferably from 0.05% by weight to 1.5% by weight and more preferably from 0.1% by weight to 1% by weight. The substances in question are also used in water-free form.

Other suitable builders for the purposes of the present invention are crystalline alkali metal silicates and fine-particle alkali metal alumosilicates, more particularly zeolites of the NaA, X and/or P types. Suitable zeolites normally have a calcium binding capacity of 100 to 200 mg CaO/g, as determined in accordance with DE 24 12 837. Their particle size is typically in the range from 1 $\mu$m to 10 $\mu$m. They are used in dry form. In the present case, the water present in bound form in the zeolites is not problematical. Preferred crystalline silicates, which may be present on their own or in the form of a mixture with the alumosilicates mentioned, are crystalline layer silicates with the formula $NaMSi_xO_{2x}.yH_2O$, where M is hydrogen or sodium, x is a number of 1.9 to 4 and y is a number of 0 to 20. Preferred values for x are 2, 3 and 4. Crystalline layer silicates such as these are described, for example, in European patent application EP 164 514. Both β- and δ-sodium disilicates $Na_2Si_2O_2.yH_2O$ are particularly preferred, β-sodium disilicate being obtainable, for example, by the process described in International patent application WO 91/08171. Useful crystalline silicates are marketed under the names of SKS6 (Hoechst) and Nabion® 15 (Rhone-Poulenc). The content of organic builder material in the paste may be up to 35% by weight and is preferably up to 25% by weight and more preferably between 10% by weight and 25% by weight.

Where the presence of phosphates is not ecologically harmful in the use of the detergents according to the invention (for example in phosphate-eliminating wastewater treatment), polymeric alkali metal phosphates, such as sodium tripolyphosphate, may also be present in the paste-form detergents according to the invention. Their percentage content is preferably up to 20% by weight, based on the detergent as a whole, the percentage content of other solids, for example the alkali metal silicate and/or alumosilicate, being reduced accordingly.

In one preferred embodiment, the detergents according to the invention contain 5% by weight to 25% by weight and, more particularly, 10% by weight to 20% by weight of builders.

The bleaching component (C) is a mixture of oxygen-containing oxidizing agent and bleach activator. The oxidizing agent used is selected in particular from inorganic peroxygen compounds, sodium perborate tetrahydrate and sodium perborate monohydrate besides sodium percarbonate being of particular significance. Other suitable oxidizing agents are, for example, persulfates, peroxypyrophosphates, citrate perhydrates and $H_2O_2$-yielding peracidic salts or peracids, such as perbenzoates, peroxophthalates, diperoxyazelaic acid or diperoxydodecanedioic acid. Sodium percarbonate, sodium persulfate and/or sodium perborate monohydrate are preferably used.

The oxidizing performance of the oxidizing agents mentioned is improved by the use of bleach activators which form peroxocarboxylic acids under perhydrolysis conditions. Many such bleach activators have been proposed in the literature, above all from the classes of N- and O-acyl compounds, for example polyacylated alkylenediamines, more particularly tetraacetyl ethylenediamine, acylated glycolurils, more particularly tetraacetyl glycoluril, N-acylated hydantoins, hydrazides, triazoles, hydrotriazines, urazoles, diketopiperazines, sulfuryl amides and cyanurates, also carboxylic anhydrides, more particularly phthalic anhydride, carboxylic acid esters, more particularly sodium nonanoyloxybenzene sulfonate, sodium isononanoyloxybenzene sulfonate and triacetin (glycerol triacetate), and acylated sugar derivatives, such as pentaacetyl glucose. A bleach activator which forms peracetic acid under the washing conditions is preferably used, tetraacetyl ethylenediamine being particularly preferred. Through the addition of bleach activators, the bleaching effect of aqueous peroxide liquors can be increased to such an extent that substantially the same effects occur at temperatures of only 60° C. as are obtained at 95° C. with the peroxide liquor alone.

An increase in bleaching performance, particularly at even lower temperatures, can be obtained by using transition metal salts and complexes, as proposed for example in European patent applications EP 0 392 592, EP 0 443 651, EP 0 458 397, EP 0 544 490, EP 0 549 271, EP 0 630 964 or EP 0 693 550, as so-called bleach catalysts in addition to or instead of conventional bleach activators. The transition metal complexes known as bleach-activating catalysts from German patent applications DE 195 29 905, DE 195 36 082, DE 196 05 688, DE 196 20 411 and DE 196 20 267 are also particularly suitable. Bleach-activating transition metal complexes, more particularly with the central atoms Mn, Fe, Co, Cu, Mo, V, Ti and/or Ru, are present in the detergents according to the invention in quantities of preferably up to 1% by weight and, more preferably, between 0.0025% by weight and 0.25% by weight.

Component (C) preferably contains from 60 to 95% by weight, based on component (C), of oxidizing agent and from 5 to 40% by weight, based on component (C), of bleach activator. The quantities of the constituents of the component are preferably selected so that the detergent according to the invention contains 5 to 25% by weight and, more particularly, 10 to 20% by weight of oxidizing agent and 1 to 10% by weight and, more particularly, 3 to 8% by weight of bleach activator.

The detergents according to the invention may contain washing alkalis as further components. The washing alkalis are predominantly assigned to the solid phase. A preferred washing alkali is amorphous alkali metal silicate, more particularly sodium metasilicate with an $Na_2O$ to $SiO_2$ ratio of 1:0.8 to 1:1.3 and preferably 1:1, which is used in water-free form. Besides the metasilicate, water-free alkali metal carbonate or alkali metal hydrogen carbonate is also suitable although, as a result of absorption processes, it does require larger amounts of liquid phase and, accordingly, is less preferred. The percentage content of washing alkalis, particularly silicate, in the detergent may be between 10% by weight and 70% by weight and is preferably between 15% by weight and 50% by weight and, more particularly, between 25% by weight and 45% by weight. Alkali metal carbonate or alkali metal hydrogen carbonate is preferably present in quantities of at most up to 20% by weight and, more particularly, below 10% by weight.

In order to increase the physical stability and chemical stability of, in particular, the bleach activator component and any enzymes present, dehydrating agents, for example in the form of salts which bind water of crystallization, such as water-free sodium acetate, calcium sulfate, calcium chloride, sodium hydroxide, magnesium silicate, or metal oxides, such as CaO, MgO, $P_4O_{10}$ or $Al_2O_3$, may also be used. Dehydrating agents such as these, by which the water content of detergents according to the invention can be reduced to particularly low levels, are present in the detergents according to the invention in quantities of, preferably, 1% by weight to 10% by weight and, more preferably, 2% by weight to 8% by weight.

In addition, a detergent according to the invention may contain other washing auxiliaries which may normally be present in quantities of up to 15% by weight, based on the final detergent. Suitable washing auxiliaries are, for example, redeposition inhibitors, soil release agents, optical brighteners, enzymes, foam regulators and/or dyes and fragrances. Where fragrances, which are generally liquid, are present in the detergent, they are assigned to the liquid phase. However, in view of the small amount used, they have little effect on the flow behavior of the pastes.

Suitable redeposition inhibitors and soil release agents are cellulose ethers, such as carboxymethyl cellulose, methyl cellulose, hydroxyalkyl celluloses and cellulose mixed ethers, such as methyl hydroxyethyl cellulose, methyl hydroxypropyl cellulose and methyl carboxymethyl cellulose. Sodium carboxymethyl cellulose and mixtures thereof with methyl cellulose are preferably used. The soil release agents normally used include copolyesters containing dicarboxylic acid units, alkylene glycol units and polyalkylene glycol units. Soil-releasing copolyesters of the type mentioned and their use in detergents have been known for some time. For example, DE-OS 16 17 141 describes a washing process using polyethylene terephthalate/polyoxyethylene glycol copolymers. DE-OS 22 00 911 relates to detergents containing nonionic surfactant and a copolymer of polyoxyethylene glycol and polyethylene terephthalate. DE-OS 22 53 063 describes acidic textile finishing formulations containing a copolymer of a dibasic carboxylic acid and an alkylene or cycloalkylene polyglycol and, optionally, an alkylene or cycloalkylene glycol. European patent EP 066 944 relates to textile treatment formulations containing a copolyester of ethylene glycol, polyethylene glycol, aromatic dicarboxylic acid and sulfonated aromatic dicarboxylic acid in certain molar ratios. European patent EP 185 427 describes methyl- or ethyl-terminated polyesters containing ethylene and/or propylene terephthalate units and polyethylene oxide terephthalate units and detergents containing these soil-release polymers. European patent EP 241 984 relates to a polyester containing substituted ethylene units and glycerol units in addition to oxyethylene groups and terephthalic acid units. The percentage content of redeposition inhibitors and/or soil release agents in the detergents according to the invention is generally not more than 2% by weight and is preferably between 0.5% by weight and 1.5% by weight.

The detergents may contain, for example, derivatives of diaminostilbene disulfonic acid or alkali metal salts thereof as optical brighteners, in particular for textiles of cellulose fibers (for example cotton). Suitable optical brighteners are, for example, salts of 4,4'-bis-(2-anilino-4-morpholino-1,3,5-triazin6-ylamino)-stilbene-2,2'-disulfonic acid or compounds of similar structure which, instead of the morpholino group, contain a diethanolamino group, a methylamino group or a 2-methoxyethylamino group. Brighteners of the substituted 4,4'-distyryl diphenyl type, for example 4,4'-bis-(4-chloro-3 -sulfostyryl)-diphenyl, may also be present. Mixtures of brighteners may also be used. Brighteners of the 1,3-diaryl-2-pyrazoline type, for example 1-(p-sulfoamoylphenyl)-3-(p-chlorophenyl)-2-pyrazoline, and compounds of similar structure are particularly suitable for polyamide fibers. The content of optical brighteners or brightener mixtures in the detergent according to the invention is generally not more than 1% by weight and is preferably between 0.05% by weight and 0.5% by weight.

The enzymes optionally present in the detergents according to the invention may be selected in particular from the classes of proteases, lipases, cutinases, amylases, pullulanases, xylanases, hemicellulases, cellulases, peroxidases and oxidases or mixtures thereof, protease, amylase and/or lipase being particularly preferred. The percentage content of enzymes is preferably between 0.2% by weight and 1.5% by weight and more preferably between 0.5% by weight and 1% by weight. The enzymes may be incorporated in the pastes in the usual way, i.e. adsorbed to substrates and/or encapsulated in shell-forming substances or in the form of concentrated water-free liquid formulations. Useful proteases are known, for example, from International patent applications WO 91/02792, WO 92/21760, WO 93/05134, WO 93/07276, WO 93/18140, WO 93/24623, WO 94/02618, WO 94/23053, WO 94/25579, WO 94/25583, WO 95/02044, WO 95/05477, WO 95/07350, WO 95/10592, WO 95/10615, WO 95/20039, WO 95/20663, WO 95/23211, WO 95/27049, WO 95/30010, WO 95/30011, WO 95/30743 and WO 95/34627. Enzymes stabilized against oxidative damage are preferred, examples of such enzymes being the proteases and amylases known under the trade names of Durazym® or Purafect® OxP and Duramyl® or Purafect® OxAm.

The typical foam regulators suitable for use in the detergents according to the invention include, for example, polysiloxane/silica mixtures in which the fine-particle silica is preferably silanized. The polysiloxanes may consist both of linear compounds and crosslinked polysiloxane resins and mixtures thereof. Other defoamers are paraffin hydrocarbons, more particularly microparaffins and paraffin waxes with melting points above 40° C., saturated fatty acids and soaps containing in particular 20 to 22 carbon atoms, for example sodium behenate, and alkali metal salts of phosphoric acid monoalkyl and/or dialkyl esters in which the alkyl chains contain 12 to 22 carbon atoms. Sodium monoalkyl phosphate and/or dialkyl phosphate containing $C_{16-18}$ alkyl groups is/are particularly preferred. The percentage content of foam regulator is preferably from 0.2% by weight to 2% by weight. In many cases, the tendency towards foaming can be reduced by suitably selecting the nonionic surfactants so that there may be no need at all to use defoaming agents.

The present invention also relates to a process for the production of the paste-form detergent according to the invention, in which the constituents of component (A), i.e. the nonionic surfactants and optionally the synthetic anionic surfactants and soap, are mixed to form a homogeneous compound and the constituents of components (B), (C) and optionally other constituents are incorporated in the resulting compound.

The detergent according to the invention thus produced is a paste and normally consists of a liquid phase and a fine-particle solid phase dispersed therein. The liquid phase of such detergents is essentially formed by the surfactants, particularly nonionic surfactants, present in the detergent according to the invention. A detergent according to the invention preferably has a viscosity at 20° C. of 70,000 mPa·s to 110,000 mPa·s, as measured with a Brookfield rotational viscosimeter (spindle No. 7) at 5 r.p.m. Under otherwise the same conditions, the viscosity at 50 r.p.m. is preferably between 18,000 mPa·s and 25,000 mPa·s. In one particular embodiment of the invention, the paste-form detergent preferably has such a viscosity at room temperature that it does not flow under the effect of gravity. In this case, it is preferably particularly pseudoplastic, i.e. it has a distinctly lower viscosity on shearing and flows under the effect of gravity; in one particularly preferred embodiment, the paste has a viscosity of 8,000 mPa·s to 45,000 mPa·s at 25° C. and at a shear rate of 0.01 $s^{-1}$, as determined with a Bohlin CVO CS rheometer with a plate/plate measuring system, plate interval 1 to 3 mm. On exposure to adequate shear forces, a detergent according to the invention preferably has a considerably lower viscosity, generally 100 to 2,000 times lower, more particularly in the range from 40 mPa·s to 60 mPa·s at a shear rate of 10 $s^{-1}$, but under otherwise the same measuring conditions. In order to take into account any thixotropic effect of the paste, the viscosity valus are read off after a measuring time of 3 minutes. The reduction in viscosity on shearing is largely reversible, i.e. after the shear force has been removed, the paste returns to its original physical state without separating. It is important in this connection to bear in mind the fact that the viscosities mentioned are not measured immediately after production of the paste, but after a period of storage of the paste when it is so to speak in equilibrium, because the shear forces applied during the production process lead to a relatively low paste viscosity which only increases gradually to the critical end viscosity. In general, storage times of 1 month are entirely sufficient for this purpose.

The detergent according to the invention may be dispensed by conventional paste dispensers of the type described, for example, in International patent application WO 95/29282, German patent application DE 196 05 906, German patent DE 44 30 418 or European patents EP 0 295 525 and EP 0 356 707. A particularly suitable dispenser for pseudoplastic paste-form detergents is known, for example, from International patent application WO 95/09263 and is preferably used for dispensing the pseudoplastic pastes according to the invention. The detergents according to the invention may also be portion-packed, more particularly in water-soluble films. Corresponding films are described, for example, in European patent application EP 252 151.

EXAMPLES

Some examples of detergents according to the invention are given in the following Table.

TABLE 1

Composition of paste-form detergents (% by weight)

| Components | Examples 1 | 2 | 3 | 4 | 5 | 6 | 7 | 8 |
|---|---|---|---|---|---|---|---|---|
| Nonionic surfactant I[a)] | 38 | 19 | 38 | 19 | — | 19 | — | — |
| Nonionic surfactant II[b)] | — | 19 | — | 19 | 19 | — | — | — |
| Nonionic surfactant III[c)] | — | — | — | — | — | 19 | — | — |
| Nonionic surfactant IV[d)] | — | — | — | — | 19 | — | — | — |

TABLE 1-continued

Composition of paste-form detergents (% by weight)

| Components | Examples 1 | 2 | 3 | 4 | 5 | 6 | 7 | 8 |
|---|---|---|---|---|---|---|---|---|
| Nonionic surfactant V[e)] | — | — | — | — | — | — | 16 | 15 |
| Nonionic surfactant VI[f)] | — | — | — | — | — | — | 5 | — |
| Nonionic surfactant VII[g)] | — | — | — | — | — | — | — | 6 |
| Nonionic surfactant VIII[h)] | — | — | — | — | — | — | 16 | 14 |
| Soap I[i] | 6 | 6 | 16 | — | 6 | 2 | — | — |
| Soap II[k)] | — | — | — | — | — | — | 1 | 0.5 |
| Soap III[l)] | — | — | — | 8 | — | — | — | — |
| Fatty acid[m)] | — | — | — | 6 | — | — | — | — |
| NaOH | — | — | — | 2.6 | — | — | — | — |
| Builder I[n)] | 0.6 | 0.6 | 0.6 | 0.6 | 0.6 | 0.6 | — | — |
| Builder II[o)] | — | — | 5 | 5 | — | 5 | 4 | 4 |
| Builder III[p)] | 10 | 10 | — | — | 10 | 14 | — | — |
| Na perborate monohydrate | 21 | 21 | 21 | 21 | 21 | 18 | 18 | 18 |
| Triacetin | — | — | 10 | 10 | 10 | — | — | — |
| TAED | 6 | 6 | 6 | 6 | 6 | 6 | 6 | 6 |
| Hydrophobic $SIO_2$ | — | — | — | — | — | — | 2 | 2.5 |
| Na acetate | — | — | — | — | — | — | 5 | 5 |
| Polyethylene glycol | 6 | 6 | — | — | — | 6 | — | — |
| Silicone foam inhibitor | 0.1 | 0.1 | 0.1 | 0.1 | 0.1 | 0.1 | 0.1 | 0.1 |
| Enzyme[q)] | 0.8 | 0.8 | 0.8 | 0.8 | 0.8 | 0.8 | 0.8 | 0.8 |
| Optical brightener | 0.23 | 0.23 | 0.23 | 0.23 | 0.23 | 0.23 | 0.23 | 0.23 |
| Na carbonate | to 100 | | | | | | | |

[a)] $C_{12-18}$ fatty alcohol + 7 EO (Dehydol ® LT 7; manufacturer Henkel KGaA)
[b)] $C_{9-11}$ fatty alcohol + 3 EO (Dehydol ® D3; manufacturer Henkel KGaA)
[c)] $C_{12-14}$ fatty alcohol + 4 EO
[d)] $C_{12-14}$ fatty alcohol + 3 EO + 4 EO
[e)] $C_{13-15}$ fatty alcohol + 7 EO (Lutensol ® AO 7; manufacturer BASF AG)
[f)] Isotridecyl alcohol + 3 EO (Lutensol ® TO 3; manufacturer BASF AG)
[g)] Isodecyl alcohol + 3 EO (Lutensol ® ON 30; manufacturer BASF AG)
[h)] $C_{14-15}$ alcohol + 4 EO (Dobanol °0 45/4; manufacturer Shell AG)
[i)] $C_{12/18}$ fatty acid Na salt (Edenor ® NAK 90; manufacturer Henkel KGaA)
[k)] $C_{16/22}$ fatty acid Na salt (Edenor ® HT 35; manufacturer Henkel KGaA)
[l)] $C_{12}$ fatty acid, 92–94% saponified (Edenor ® C12 92/94; manufacturer Henkel KGaA)
[m)] From palm kernel oil (Edenor ® PK 1805; manufacturer Henkel KGaA)
[n)] Phosphonate (Tuprinal ® 2 NZ; manufacturer Henkel KGaA)
[o)] Polyermic polycarboxylate (Sokalan ® CP 5; manufacturer BASF AG)
[p)] Na citrate, water-free
[q)] Protease granules (BLAP ® S200; manufacturer Biozym)

The paste-form detergents showed very good stability in storage despite the presence of oxidizing agent and bleach activator. For example, their active oxygen content had only fallen to 95% of the initial value after storage for 8 weeks at 30° C./40% relative air humidity.

What is claimed is:

1. A paste-form detergent composition that is substantially free of water and comprises a solid phase dispersed in a liquid phase, said detergent composition containing (A) 20% to 58% by weight of a liquid surfactant component comprising a nonionic surfactant (B) 2% to 40% by weight of solid builders, and (C) 2% to 40% by weight of a solid bleaching component comprising a peroxygen-containing oxidizing agent and a bleach activator, based on the weight of the composition, wherein the paste-form detergent composition has a viscosity, at 20° C. of from 70,000 mPas to 110,000 mPas, as measured with a Brookfield rotational viscometer at 5 r.p.m, wherein the liquid phase comprises the liquid surfactant component (A), said liquid surfactant component comprising a nonionic surfactant or surfactants selected from the group consisting of ethoxylated and optionally propoxylated alcohols corresponding to formula I:

$$R^1—(OC_2H_4)_m—(OC_3H_6)_n—OH \quad (I)$$

in which $R^1$ is an alkyl or alkenyl group containing 6 to 11 carbon atoms, m has a value of 3 to 15 and n has a value of 0 to 6, and formula II:

$$R^2—(OC_2H_4)_o—(OC_3H_6)_p—OH \quad (II)$$

in which $R^2$ is an alkyl or alkenyl group containing 12 to 22 carbon atoms, o has a value of 3 to 15 and p has a value of 0 to 6, and wherein the solid phase comprises the builder and bleaching components (B) and (C) in fine particulate form having a mean particle size of 5 to 200 $\mu$m and no more than 10% by weight of the particles are larger than 200 $\mu$m.

2. A composition as in claim 1 wherein said surfactant component contains up to 10% by weight of anionic surfactant selected from the group consisting of alkyl benzene sulfonates and alkyl or alkenyl sulfates, based on the weight of said surfactant component.

3. A composition as in claim 1 wherein said composition contains up to 20% by weight of soap, based on the weight of said composition.

4. A composition as in claim 1 wherein said bleaching component comprises 60% to 95% by weight of an oxidizing agent and 5% to 40% by weight of a bleach activator which forms percarboxylic acid under perhydrolysis conditions, based on the weight of said bleaching component.

5. A composition as in claim 1 wherein said composition contains up to 1% by weight of a bleach-activating transition metal complex, based on the weight of said composition.

6. A composition as in claim 5 wherein said transition metal complex contains a central atom selected from the group consisting of Mn, Fe, Co, Cu, Mo, V, Ti and Ru.

7. A composition as in claim 1 wherein said builders comprise 10% to 70% by weight of washing alkalis, based on the weight of said composition.

8. A composition as in claim 1 further containing from 0.2% to 1.5% by weight of enzyme, based on the weight of said composition.

9. A composition as in claim 1 further containing from 1% to 10% by weight of a dehydrating agent, based on the weight of said composition.

10. A process for producing a paste-form detergent composition comprising preparing a homogenous liquid surfactant component comprising a nonionic surfactant, and adding to said surfactant component (B) 2% to 40% by weight of solid builders, and (C) 2% to 40% by weight of a solid bleaching component comprising a peroxygen-containing oxidizing agent and a bleach activator, based on the weight of the composition, and wherein the paste-form detergent composition thus formed has a viscosity, at 20° C. of from 70,000 mPas to 110,000 mPas, as measured with a Brookfield rotational viscometer at 5 r.p.m, wherein said liquid surfactant component comprises a nonionic surfactant or surfactants selected from the group consisting of ethoxylated and optionally propoxylated alcohols corresponding to formula I:

$$R^1—(OC_2H_4)_m—(OC_3H_6)_n—OH \quad (I)$$

in which $R^1$ is an alkyl or alkenyl group containing 6 to 11 carbon atoms, m has a value of 3 to 15 and n has a value of 0 to 6, and formula II:

$$R^2—(OC_2H_4)_o—(OC_3H_6)_p—OH \quad (II)$$

in which $R^2$ is an alkyl or alkenyl group containing 12 to 22 carbon atoms, o has a value of 3 to 15 and p has a value of 0 to 6, and wherein the solid phase comprises the builder and bleaching components (B) and (C) in fine particulate form having a mean particle size of 5 to 200 $\mu$m and no more than 10% by weight of the particles are larger than 200 $\mu$m.

11. A process as in claim 10 wherein said surfactant component contains up to 10% by weight of anionic surfactant selected from the group consisting of alkyl benzene sulfonates and alkyl or alkenyl sulfates, based on the weight of said surfactant component.

12. A process as in claim 10 including adding to said composition up to 20% by weight of soap, based on the weight of said composition.

13. A process as in claim 10 wherein said bleaching component comprises 60% to 95% by weight of an oxidizing agent and 5% to 40% by weight of a bleach activator which forms percarboxylic acid under perhydrolysis conditions, based on the weight of said bleaching component.

14. A process as in claim 10 including adding to said composition up to 1% by weight of a bleach-activating transition metal complex, based on the weight of said composition.

15. A process as in claim 14 wherein said transition metal complex contains a central atom selected from the group consisting of Mn, Fe, Co, Cu, Mo, V, Ti and Ru.

* * * * *